United States Patent [19]

Linlor

[11] Patent Number: 4,782,303

[45] Date of Patent: Nov. 1, 1988

[54] CURRENT GUIDING SYSTEM

[76] Inventor: William I. Linlor, 107 Boyden La., Fortuna, Calif. 95540

[21] Appl. No.: 34,626

[22] Filed: Apr. 6, 1987

[51] Int. Cl.[4] ..... H05H 1/03

[52] U.S. Cl. ..... 328/228; 315/5.35; 315/4; 313/156; 313/160; 376/107

[58] Field of Search ..... 376/102, 107, 127, 129, 376/130; 328/228, 233; 315/5.34, 5.35, 5.51, 4, 3; 313/156, 160

[56] References Cited

U.S. PATENT DOCUMENTS

| | | | |
|---|---|---|---|
| 2,736,799 | 2/1956 | Christofilos | 250/396 ML |
| 3,510,713 | 5/1970 | Bennett | 328/228 X |
| 3,914,637 | 10/1975 | Bennett | 250/396 R |
| 4,079,285 | 3/1978 | Little | 250/396 R X |
| 4,240,873 | 12/1980 | Linlor | 376/107 |
| 4,246,067 | 1/1981 | Linlor | 376/107 X |
| 4,507,614 | 3/1985 | Prono et al. | 328/228 X |
| 4,639,641 | 1/1987 | Tronc | 315/5.42 |

*Primary Examiner*—Leo H. Boudreau
*Assistant Examiner*—Mark R. Powell

[57] ABSTRACT

The magnetomotive force of a current produces a magnetic field in magnetic material which encircles the current. Although magnetic material attracts a current, material having vanes *repels* the current because of magnetic flux lines produced between the vanes. The magnetic material is symmetrically arranged, and consists of pairs of radial, magnetic vanes connected by a magnetic member encircling the current. The magnetic member has a uniformly-distributed coil whose ampere-turns oppose the magnetomotive force of the current. The number of magnetic members is n. The angular spacing of the vanes equals 180/n. The coil ampere-turns equals $I(n-1)/n$, where I is the current. The guiding of the current occurs for one-half of the area of the plane on which the magnetic material is located. To obtain guiding for the other half, a second plane has magnetic material similar to that on the original plane, but rotated by the angle 180/n. Such rotation angles are continued in successive planes spaced along the current axis. The current guiding system can be used for straight line paths, or for a curved path that is closed on itself. The invention can be employed for direct current as well as for alternating current. Major applications include controlled fusion systems and particle accelerators. For controlled fusion systems, the invention can be applied to beam guidance. For particle accelerators the invention can be combined with acceleration units to maintain or even compress a beam while it is accelerated.

9 Claims, 1 Drawing Sheet

CURRENT GUIDING SYSTEM

TECHNICAL FIELD OF THE INVENTION

This invention relates to a system to guide a current along a desired path. The current may flow in a conductor, or it may flow in the form of a beam consisting of moving electrically-charged particles, such as electrons and ions. This invention applies to situations in which the current is guided by electromagnetic effects only, without physical contact on the conductor or beam.

BACKGROUND ART

Prior art involves various magnetic fields that interact with a current to guide it. The force relation is:

$$F=0.1\ B\ l \qquad (1)$$

The force F is in dynes per centimeter length; the magnetic flux density B is in gauss; and the current l is in amperes.

In regard to prior art, attempts have been made to guide a current along a desired path, such as the Z-axis of a rectangular coordinate system, by the use of magnets arranged in the XY plane. Such attempts have not been successful because beneficial effects in one region of the plane have been counterbalanced by instabilities in other regions of the plane. Similar difficulties occur it attempts are made to utilize current distributions located in the vicinity of the current that is to be guided.

The guiding of currents has been accomplished in prior art by the use of magnetic fields having special shape, such as betatron fields and "strong-focusing fields." Such magnetic fields have been produced by sources that are external to the guided current. No publications in the past have described systems in which the current to be guided supplies magnetomotive force to encircling magnetic material, with the objective of guiding the current via magnetic fields produced in the encircling magnetic material.

STATEMENT OF INVENTION

It is an object of this invention to provide an electromagnetic system to guide a current l along a desired path, by the use of specially-shaped magnetic materials that surround the current l.

It is a further object of this invention to utilize the magnetomotive force of the current l to produce a magnetic field B so that the force F given by equation (1) guides the current l along a desired path.

It is still another object of this invention to provide essentially continuous forces on the current l by arranging the magnetic materials in various azimuthal configurations along the desired path.

The attainment of these and related objects can be achieved through the use of the novel configurations herein disclosed of magnetic materials. A current guiding system in accordance with this invention has magnetic material that *encircles* the current l and has vanes between which a magnetic field B is produced by the current l. The guiding force F is produced by the interaction of magnetic field B and current l in accordance with equation (1). There are a plurality of vane sets distributed symmetrically in the azimuthal direction; these vane sets have an axis that coincides with the desired guidance path of the system. The magnetic material that connects each vane set has windings with ampere-turns D that produce a magnetomotive force in opposition to but not completely cancelling the magnetomotive force of the current l.

The vane sets located in a given azimuth plane provide guiding forces over approximately one-half of the azimuth plane. To obtain guiding forces over the other half, another set of vanes in an adjacent plane are rotated relative to the vane sets of the preceding azimuth plane.

DETAILED DESCRIPTION OF THE INVENTION

Figure 1:
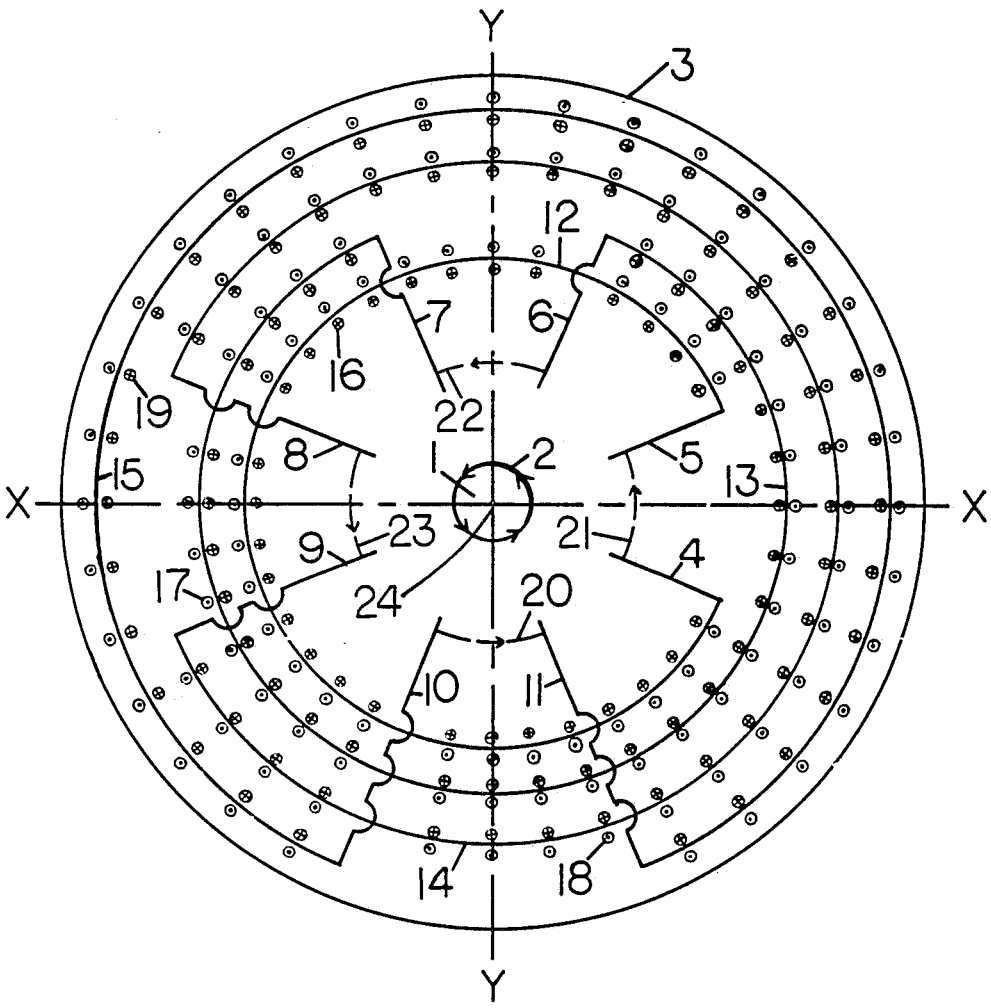
FIG. 1 is a cross-section view of four vane sets in accordance with the invention, having eight vanes distributed symmetrically around a central axis.

The following material describes the invention, defines units, and provides relations between various quantities.

The magnetomotive force, abbreviated MMF, of a current of l amperes flowing in N turns can be expressed alternatively in ampere-turns or in gilberts. The relation between ampere-turns Nl and gilberts G is:

$$G=1.257\ N\ l \text{ gilberts} \qquad (2)$$

Magnetic flux density B has units of gauss.

Magnetic field intensity H has units of gilberts per centimeter, and is expressed in oersteds.

The permeability of a material is the ratio of B/H. For air, the permeability is unity. For magnetic materials, such as iron, the permeability typically is 1,000 or greater.

Rectangular coordinates to assist in the description of the system are used. The current direction is along the Z-axis, and the XY plane is the azimuth plane. The present invention utilizes magnetic materials arranged in the XY plane, surrounding a current l whose desired path is along the Z-axis. Although a current is attracted to magnetic material in its vicinity, the present invention utilizes a configuration of magnetic materials whose net effect is that the current l is *repelled* by the surrounding magnetic materials if the current departs from the desired path along the Z-axis.

Turning now to the drawing, in FIG. 1 is shown a cross-section view of an illustrative arrangement of components in accordance with this invention. The plane of FIG. 1 is the XY-plane, having axes labelled XX and YY; this is also called an azimuth plane. The desired path of the current l, represented by 1 in the figure, is along the Z-axis represented by 24 in the figure; i. e., at the origin of the XY-plane.

It is important to establish a convention regarding current flow direction and the associated magnetomotive force (also known as MMF) direction and magnetic flux direction. The "right-hand rule" is employed in this description; namely, if the thumb of one's right hand points in the direction of current flow, the fingers of the right hand point in the direction of the associated MMF and magnetic flux lines. Also, if the fingers of the right hand point in the direction of current flowing in the turns of a coil, the thumb of the right hand points in the direction of the MMF.

A magnetic flux line 2 produced by the current 1 in FIG. 1 is a circle, coaxial with the current 1 that is taken to be flowing upward along the Z-axis out of the XY-plane. The four spaced arrows depict the direction of this magnetic flux line 2.

The magnetomotive force of the current 1 is given by equation (2), with N equal to one; this is 1.257 I gilberts. The direction of the MMF is counter-clockwise, in accordance with the above-stated convention. Alternative terminology can be employed in that the current 1 "magnetizes" surrounding magnetic material.

The upward-flowing current 1 is taken to be returning downward along the coaxial, thin shell 3, being uniformly distributed in the shell 3.

The description of the invention is facilitated by a representative example of the configuration of magnetic material. No inference should be made that the invention is limited to only this one arrangement, because others are also feasible, as will be discussed below. Eight vanes are shown in FIG. 1, namely vane 4, vane 5, vane 6, vane 7, vane 8, vane 9, vane 10, and vane 11. Each of these vanes is very thin and extends radially and in the Z-direction; the vanes are angularly spaced by the same angle of 45 degrees. A "vane set" consists of two adjacent vanes. Vane 4 and vane 5 constitute a vane set; the three other vane sets for FIG. 1 consist, respectively, of vane 6 and vane 7; vane 8 and vane 9; and vane 10 and vane 11.

Each vane must be made of magnetic material, preferably having a high permeability. The two vanes of each vane set must be connected by magnetic material that encircles the current 1; the magnetic connecting material should have a high permeability and a small cross-section. The magnetic connecting material preferably should be located as far away from the current 1 as is possible. Therefore the joining of the connecting material to the vanes should be made at the radially-outer portion of the vanes.

In FIG. 1, the magnetic connecting material from vane 4 to vane 5 is identified by the number 12, and is depicted as being a portion of a circle for simplicity. The connecting material 12 can have other shapes; however, the connecting material 12 must encircle the current 1.

The magnetic connecting material from vane 6 to vane 7 is identified by the number 13. The magnetic connecting material from vane 8 to vane 9 is identified by the number 14. The magnetic connecting material from vane 10 to vane 11 is identified by the number 15. Each of the members 13, 14, and 15 must encircle the current 1.

The magnetic connecting material 12 has a coil 16 wound on it whose turns are essentially uniformly distributed along the length of the connecting material. The magnetic connecting material 13 has a coil 17 wound on it whose turns are essentially uniformly distributed along the length of the connecting material. The magnetic connecting material 14 has a coil 18 wound on it whose turns are essentially uniformly distributed along the length of the connecting material. The magnetic connecting material 15 has a coil 19 wound on it whose turns are essentially uniformly distributed along the length of the connecting material.

It is important that the magnetic connecting material members 12, 13, 14, and 15 have minimum cross-sectional area, the reason for this is explained below.

It is also important that the direction of the current in the coils 16, 17, 18, and 19 have a direction that is related to the direction of the current 1. The required relation is: the magnetomotive force of each of the coils 16, 17, 18, and 19 must oppose the magnetomotive force of the current 1. For the case of FIG. 1, the direction of the current 1 is upward along the Z-axis (i.e., out of the plane of the paper), so the magnetomotive force of the current 1 is in the counter-clockwise direction as shown by the arrows on flux line 2. The current in each of the coils 16, 17, 18, and 19 must accordingly flow in the direction as shown by the crosses and dots, in accordance with the customary convention that a "cross" means that the current is heading into the plane of the paper, and that a "dot" means that the current is heading out of the plane of the paper. The relationship between magnetomotive force and ampere-turns is shown in equation (2).

Each of the coils 16, 17, 18, and 19 has the same total ampere-turns, designated by the the letter D.

The following equation applies to the vane sets. The letter n represents the number of vane pairs for FIG. 1, n is equal to four, meaning that FIG. 1 shows four vane pairs, making a total of eight vanes. The vanes are separated by equal angles. The angular separation in degrees between adjacent vanes is:

$$\text{Vane angle} = 180/n \tag{3}$$

The relation between the ampere-turns D and the current I is:

$$D = -I\,(n-1)/n \tag{4}$$

The minus sign in equation (4) means that the magnetomotive force of the ampere-turns D opposes the magnetomotive force of the current I.

FIG. 1 serves to illustrate the novel and important features of the invention. Because the drawing is of schematic nature, additional description is helpful in explaining the details of the invention.

The vanes, 4, 5, 6, 7, 8, 9, 10, and 11 are composed of thin magnetic material such as iron. Each vane as a radial extent from an inner radius Ra to an outer radius Rb. The length of each vane, along the Z-axis direction, is Za. The area of each vane is given by Av:

$$Av = Za\,(Rb - Ra) \tag{5}$$

The magnetic connecting material 12, 13, 14, and 15 of each vane pair, should have minimum cross-sectional area. The reason for this is to avoid the attractive effect of magnetic material for the current 1. For example, if a current is at the axis of an iron cylinder, it is in a location of neutral equilibrium; any radial displacement of the current results in an attraction of the current and its "image" current in the adjacent portion of the iron cylinder. Such an attractive force can be reduced by changing the cylinder into thin wire loops, for example, that have the same axis as the cylinder. Another way of reducing the amount of the attractive force is to employ ribbons instead of thin wire loops; such ribbons would have the same axis as the cylinder, and would have the thin dimension parallel to the axis. The wide dimension of the ribbons would be perpendicular to the axis of the cylinder.

Returning now to FIG. 1, the magnetic connecting material 12, 13, 14, and 15, of each vane pair preferably should consist of ribbons having minimum cross-sectional area, Ac, whose width dimensions are essentially perpendicular to the direction of the current 1.

The vanes have magnetic flux lines between pairs of vanes, as a result of the interactions explained above. Vane pair 4 and 5 have flux line 21; vane pair 6 and 7 have flux line 22; vane pair 8 and 9 have flux line 23; and vane pair 10 and 11 have flux line 20. These flux lines, 20, 21, 22, and 23 have a direction to repel the current 1 if it approaches any of them. No flux lines cross from vane 5 to vane 6; nor from vane 7 to vane 8; nor from vane 9 to vane 10; nor from vane 11 to vane 4. To provide the desired repulsive force in such regions, the configuration shown in FIG. 1 should be used in a second plane that is separated in the Z-axis direction from the plane of FIG. 1, the configuration in the second plane being partially rotated so as to produce an angular displacement with respect to the configuration in the first plane. Similar angular displacements (i. e., partial rotation) of the configurations in successive planes should be made, along the Z-axis. For a wire, the average force on the current 1 taken over many planes is directed toward the axis, 24. For a beam of charged particles, the average force obtained by traversing many planes is directed toward the axis, 24. For clarity, these comments regarding angular displacements of the successive configurations are repeated in connection with illustrative Example A, below.

ILLUSTRATIVE EXAMPLE A

The first illustrative example is shown in FIG. 1. For this, the number of vane sets n is four; that is, the four vane sets are spaced 90 degrees apart. The angular spacing between adjacent vanes is 45 degrees, as given by equation (3). The ampere-turns D is equal to $-0.75$ l, which means that the MMF of winding D opposes the MMF of the current l. The net MMF (in ampere-turns) between the vanes of any vane set is equal to 0.25 l, which produces the magnetic flux line 20, between the vane 10 and the vane 11. The MMF 0.25 l produces magnetic flux line 21 between vanes 4 and 5; it produces magnetic flux line 22 between vanes 6 and 7; and it produces magnetic flux line 23 between vanes 8 and 9.

It is important to note that no flux lines cross the gap from vane 5 to vane 6. Similarly, no flux lines cross the gap from vane 7 to vane 8; nor from vane 9 to vane 10; nor from vane 11 to vane 4. This is a novel and important result of the invention, and has no counterpart in prior art.

The magnetic flux density associated with flux line 20 can be calculated as follows. The length of the flux line 20 is designated by L. In accordance with equation (2), the MMF in gilberts between vanes 10 and 11 is:

$$G=1.257\times 0.25\ l \tag{6}$$

With the length L expressed in centimeters, the magnetic flux density associated with flux line 20 is:

$$B=1.257\times 0.25\ l/L \text{ gauss} \tag{7}$$

This value of B also represents the magnetic flux density associated with the flux lines 21, 22, and 23.

It is important to note that the direction of the flux lines 20, 21, 22, and 23 is such as to repel the current l if it approaches any one of these flux lines. In regions where no magnetic flux density exists, the current l does not experience a force.

As pointed out above, no flux lines cross the gap from vane 5 to vane 6; nor from vane 7 to vane 8; nor from vane 9 to vane 10; nor from vane 11 to vane 4. If the current l were to approach the regions where no flux lines are present, it would not be repelled back to the axis (which is the desired location for the current l). To provide the desired repulsive force, the configuration shown in FIG. 1 should be rotated and located at a different value of the Z-axis. The angle of rotation preferably should be equal to twice the vane angle given by equation (3), although angles other than this can be used, but with some sacrifice in repulsive force. The distance along the Z-axis separating successive rotated configurations preferably should be equal to approximately half the vane length Za, although distances greater or less than this can be used, but with some sacrifice in repulsive force.

The repulsive effects of the magnetic vanes 4, 5, 6, 7, 8, 9, 10, and 11 dominate over the attractive effects of the magnetic connecting material 12, 13, 14, and 15.

The rotation of the configuration of FIG. 1 preferably should be repeated at intervals as discussed above along the entire path length of the current l. In this way the current l is guided along the desired path (i. e., the Z-axis) by the net repulsive effects of the magnetic vanes surrounding the current.

ILLUSTRATIVE EXAMPLE B

For this example, the number of vane sets is taken to be six, for which a total of twelve vanes is necessary. The angular spacing between adjacent vanes is 30 degrees, as given by equation (3). The ampere-turns D is equal to $-51/6$. The net MMF (in ampere-turns) between the vanes of any vane set is equal to l/6.

The rest of the analysis of Example B is similar to the analysis of the preceding Example A.

ILLUSTRATIVE EXAMPLE C

In the two preceding examples, A and B, attention was concentrated on the description of the invention and relations between various quantities. In this example, attention is concentrated on magnitudes and dimensions for an illustrative example. It should be apparent to those skilled in the art that the magnitudes and dimensions given in this Example C are intended for illustrative purposes, and that various changes in magnitudes, changes in form and changes in details of the invention as shown and described may be made, without departing from the basic elements of the description given in the preceding material.

The physical design of a current guiding system can be accomplished with the help of the quantities listed in the following Table I:

TABLE I l: Current 1, amperes
Ra: Inner radial extent of vane 4, cm.
Rb: Outer radial extent of vane 4, cm.
Za: Length of vane in Z-axis direction, cm
Tv: Thickness of each vane 4, cm.
Av: Area of vane 4, sq. cm.
Ar: Area of ribbon 12, sq. cm.
Ba: Flux density with flux line 20. gauss
Br: Flux density in ribbon 12, gauss
Oe: Oersteds in ribbon of iron at 19,000 gauss
Lr: Length of ribbon 12, cm.
Gr: Gilberts of MMF drop in ribbon 12
D: Ampere-turns of coil 16
Gi: Gilberts of current 1
Ls: Spacing between adjacent configurations, cm.
L: Flux line 20 length, cm.
Tr: Ribbon 12 thickness, cm.
Tw: Ribbon 12 width, cm.
Np: Number of planes
Lt: Total length of system, cm.

Illustrative values of the quantities listed in Table I are listed in the following Table II for a preliminary design and for a physical design. The preliminary design is based on the assumption that magnetic materials are available that do not saturate; i. e., that no MMF drop occurs as a consequence of the magnetic flux intensity in the material. The physical design is based on published properties of commerically-pure iron that has been annealed; at the magnetic flux density of 19,000 gauss, the iron has an MMF drop per centimeter of 145 oersteds. The total MMF drop in a ribbon of such iron having a length of Lr centimeters is 145 Lr gilberts. This MMF drop opposes the MMF of the current 1, and therefore the opposing ampere-turns D must be adjusted to include this MMF drop in the iron. In the physical design, no allowance is made for effects of "leakage flux" because to include such effects would unnecessarily complicate the design. Those skilled in the art of magnetic circuit design are familiar with the corrections that can be made to include the effects of leakage flux. The magnetic flux density Ba associated with flux line 20 is calculated by use of equation (7). The value of the magnetic flux density in the ribbon 12 is obtained by multiplying Ba by the ratio of Av divided by Ar. For the Ba value of 2,000 gauss, the value of Br is 19,000 gauss, and for pure iron the associated MMF drop per centimeter is 145 oersteds, as pointed out above.

In Table II, the column labelled "Prelim" refers to the preliminary design of the system. The column labelled "Physical" refers to the design based on physical properties of iron.

TABLE II

| | Prelim | Physical |
|---|---|---|
| I | 100,000 | 100,000 |
| Ra | 20 | 20 |
| Rb | 50 | 22 |
| Za | 30 | 30 |
| Tv | 0.1 | 0.2 |
| Av | 900 | 60 |
| Ar | 0.1 | 6.32 |
| Ba | 2,000 | 2,000 |
| Br | — | 19,000 |
| Oe | — | 145 |
| Lr | 275 | 137 |
| Gr | — | 19,865 |
| D | 75,000 | 59,200 |
| Gi | 125,700 | 125,700 |
| Ls | 15 | 15 |
| L | 15.7 | 15.7 |
| Tr | 0.1 | 1.0 |
| Tw | 1.0 | 6.32 |
| Np | 10 | 10 |
| Lt | 450 | 450 |

CONFIGURATIONS FOR CURVED PATHS

The preceding examples described linear configurations, for which the desired current path was essentially a straight line. In such cases, the current 1 enters along the Z-axis at the front end of the system, and departs at the aft end. The system described in this patent application also applies to situations for which the desired current path is curved, and also closes on itself, such as a circle, ellipse, or other paths such as a "race-track" configuration having straight portions whose ends are joined by essentially semi-circular portions.

The application of the current-guiding system is now described for a "race-track" configuration having straight legs joined by semi-circular ends. For the straight legs, no modification of the already described system is necessary. For the semi-circular ends, each end may consist of the present system, on which is superimposed a magnetic field produced by copper coils, (a different field than that of equation 1) whose flux lines are essentially perpendicular to the plane of the semi-circular path. The intensity of this magnetic field is governed by the relation:

$$BER = Mv \tag{8}$$

where B represents the magnetic flux density perpendicular to the plane of the semi-circular path; e represents the electric charge on an ion of the beam; r represents the radius of curvature of the semi-circular path; M represents the ion mass; and v represents the velocity of the ion, all expressed in "electromagnetic units." No iron pole pieces should be used for the semicircular path, because this would adversely affect the performance of the present system whose magnetic components must conform to the teachings of this patent application.

In the end-portion of the "race-track" the semi-circular ion path represents the desired path of the current to be guided. The Z-axis of the system described in this patent application must be curved so as to coincide with the desired path of the current. With this modification of the Z-axis, the components in the XY-plane are arranged symmetrically, as in the case of the linear system.

The configurations for curved paths may take many alternative forms, and are not limited to the ones described above. The guiding of the current by the system described in this patent application may be used for curved paths without the addition of perpendicular magnetic fields, although at some sacrifice in allowable beam excursions away from the desired path. The Z-axis of the system described in this patent application must be curved so as to coincide with the desired path of the current. With this modification of the Z-axis, the components in the XY-plane are arranged symmetrically, as in the case of the linear system. Those skilled in the art may choose to trade system complexity versus system performance.

NOTE REGARDING THE TERM "CURRENT"

As stated at the beginning of these Specifications, the term "current" refers alternatively to current flow in a conductor, or to a beam of moving electrically-charged particles. The current may consist also of a mixture of moving electrons and ions.

CHARACTERISTICS OF PRESENT SYSTEM

The preceding material described the proposed system. It is important to identify some characteristics of the system that are lacking in other methods of guiding currents.

In prior art, systems have been proposed and employed that are based on the properties of super-conducting material surrounding the current. The present system does not rely on any property of the super-conducting system, which requires the presence of low temperatures. The present system can operate at any temperature for which magnetic materials exhibit a high permeability. In prior art, systems have been employed that are based on eddy currents induced in conducting material surrounding the current. Such systems are limited to high-frequency alternating current applications. The present system is frequency-independent; it can operate with either direct current or alternating current.

In prior art, systems have been employed that are based on "active guidance," or "follow-up guidance." These depend on the presence of sensing components that detect the deviation of the current from the desired path, and provide information for the application of restoring forces to bring the current back to the desired path. Such systems are complicated, expensive, and generally do not have adequately fast response action to guide currents along desired paths. The present system does not require sensing components to detect deviation of the current from the desired path. The guiding forces arise from the deviation of the current from the desired path because of the presence of magnetic field distributions that repel the current back to the desired path.

APPLICATIONS OF PRESENT SYSTEM

The current guiding system described in this patent application can be used in a variety of applications. In a linear configuration, a beam enters into the front (or beginning) end of the guidance system, then proceeds along the Z-axis along which the guiding units are located and along which conventional beam-accelerating units are interposed in accordance with state of the art technology, and finally emerges from the linear configuration at the aft end. Many other applications are possible by combining the linear configuration with conventional units. The requirement regarding integration of the present current guiding system with conventional units is that no magnetic material such as iron is introduced via the conventional units. The conventional units can be fabricated out of non-magnetic materials such as aluminum, copper, and similar materials.

In a curved configuration involving an axis that is closed on itself, the current guiding system can be used in cyclic accelerators, providing that no magnetic material is introduced via the added conventional units that are interposed among the units of the present current guiding system.

An example of an important application for the guiding system of this patent application is described in U.S. Pat. No. 4,246,067, issued on Jan. 10, 1981 to William I. Linlor, applicant of the present patent application. A thermonuclear fusion system based on ion beams is described in this cited patent; a curved configuration involving an axis that is closed on itself can guide the ion beam of the patent with the use of the units of the present current guiding system.

Another similar application for the guiding system of this patent application is described in patent application Ser. No. 969,110, filed Dec. 13, 1978, "Beam-Confined Fusion System," by William I. Linlor. Although the ion beam of patent application Ser. No. 969,110 differs from the ion beam of U.S. Pat. No. 4,246,067, the guidance system of this patent application can be employed for both of these applications.

Still another application for the guiding system of this patent application is novel and important, namely the compression of a beam by the units of the guiding system. In FIG. 1 the inner radius of the vanes is given by Ra, and the outer radius of the vanes is given by Rb. The radii Ra and Rb of the vanes can be gradually decreased as a function of distance along the Z-axis, which produces a "squeezing" or compression of the beam as it proceeds along the Z-axis.

These examples of the applications for the current guiding system are intended to be illustrative only, and many other types of applications are possible and will be apparent to those skilled in the art of electromagnetic systems.

It should further be apparent to those skilled in the art that various changes in form and details of the invention as shown and described may be made. It is intended that such changes be included within the spirit and scope of the claims appended hereto.

SUMMARY DESCRIPTION OF INVENTION

This section is intended to summarize the description of the invention in general terms, essentially paralleling the claims.

(1) The invention consists of an axis 24, along which a current 1 flows. Magnetizable means surround the current 1, and are magnetized by the current 1 thereby producing magnetic fields that repel the current 1 back to the axis 24 if the current 1 departs from the desired position along the axis 24. The result is that the magnetic fields guide the current 1 along the desired path.

(2) The invention consists of an axis 24, along which a current 1 flows. Arrays of magnetic materials surround the current 1. These arrays are arranged symmetrically with respect to the axis 24, and are magnetized by the current 1, thereby producing magnetic fields that repel the current 1 back to the axis 24 if the current 1 departs from the desired position along the axis 24. The result is that the magnetic fields guide the current 1 along the desired path.

(3) The invention consists of an axis 24, along which a current 1 flows. An array of magnetic materials surrounds the current 1, and is acted upon by the magnetomotive force of the current 1 to produce magnetic fields that guide the current 1 along the axis 24. The array of magnetic materials consists of magnetic units that are arranged symmetrically with respect to the axis 24. Each of the magnetic units consists of a pair of approximately radial magnetic vanes such as vane 4 and vane 5 that are connected to each other by a magnetic member 12 that encircles the current 1. The magnetic vanes have an angular separation approximately given by:

$$\text{Vane angle} = 180/n$$

where n denotes the number of magnetic units, which is four in the case of FIG. 1. The magnetic member 12 has on it a uniformly-distributed coil 16 having ampere-turns which oppose the magnetomotive force of the current 1 approximately in accordance with the relation:

$$\text{Ampere-turns} = -I(n-1)/n$$

wherein I represents the current 1 and n represents the number of magnetic units.

(4) Continuing with the preceding description (3), the invention consists of arrays of magnetic materials located on two adjacent planes, each of which intersects the axis 24 at approximately ninety degrees. These planes are spaced apart from each other along the axis 24. The array of magnetic materials located on the first plane is symmetrically arranged with respect to axis 24. The array of magnetic materials located on the second plane is also symmetrically arranged with respect to axis 24, but has a rotation angle with respect to the array located on the first plane. For example, in FIG. 1 vane 4 is separated from vane 5 in angle by 45 degrees, as per equation (3). Accordingly, the array located on the second plane should be rotated in angle by approximately 45 degrees with respect to the array located on the first plane.

(5) Continuing with the preceding description (3), the invention consists of a multiplicity of planes that are spaced apart along the axis 24. These planes each intersects the axis 24 at approximately ninety degrees. Each plane has on it an array of magnetic materials that are symmetrically arranged with respect to the axis 24. Using FIG. 1 as an example, each plane has an array of magnetic materials similar to FIG. 1. On the first plane, vane 4 can be taken to be located at the angle zero, for reference. On the second plane, vane 4 is located at approximately the angle 45 degrees. On the third plane, vane 4 is located at approximately the angle 90 degrees. On the fourth plane, vane 4 is located at approximately the angle 135 degrees. This sequence of angles for vane 4 on the successive planes is continued for all the remaining planes. The current 1 is introduced into the system along axis 24 at the first plane, leaves at the last plane along the axis 24.

(6) Continuing with the preceding description (5), the invention consists of placing accelerating means between the multiplicity of planes that have arrays of magnetic materials. The current 1 in this case is a beam of charged particles; these charged particles are accelerated by the accelerating means, thereby increasing the velocities of the charged particles in traversing the system from the front to the aft end.

(7) Continuing with the preceding description (5), the invention consists of decreasing the radii of the arrays of magnetic materials in the successive planes. For example, in the first plane where a beam current of charged particles enters the system, the radius Ra of FIG. 1 is 20 cm. and the radius Rb is 22 cm. In the next plane, the radius Ra is smaller, for example 19 cm. and the radius Rb is also smaller, for example 21 cm. In the next plane, the radius Ra is smaller again, for example 18 cm. and the radius Rb is also smaller again, for example 20 cm. The gradual decrease in the radii is continued throughout the remaining sequence of planes. These gradual reductions of the radii produces a corresponding "squeezing" of the beam to successively smaller radii.

(8) The invention consists of an axis 24 that is curved, and re-entrant on itself, such as a circle. The current 1 consists of a beam of charged particles that flows along the axis 24. An array of magnetic materials surrounds the beam current, and utilizes the magnetomotive force of the beam current to produce magnetic fields that guide the beam current along the axis 24. The array of magnetic materials consists of magnetic units that are arranged symmetrically around axis 24. Each magnetic unit has a pair of approximately radial magnetic vanes having an angular separation approximately given by:

$$\text{Vane angle} = 180/n$$

wherein n denotes the number of magnetic units. The pair of magnetic vanes is connected by a magnetic member encircling the beam current 1. On this magnetic member is a uniformly-distributed coil having ampere-turns that oppose the magnetomotive force of the beam current 1 approximately in accordance with the relation:

$$\text{Ampere-turns} = -l(n-1)/n$$

wherein l represents the beam current and n represents the number of magnetic units.

(9) Continuing with the preceding description (8), the invention consists of a multiplicity of planes that are spaced apart along the axis 24. These planes each intersects the axis 24 at approximately ninety degrees. Each plane has on it an array of magnetic materials that are symmetrically arranged with respect to the axis 24. The arrays of magnetic materials are positioned at rotation angles with respect to one another, as explained in the above description (5), except that the beam current 1 re-circulates along the axis 24, which is closed on itself.

(10) Continuing with the preceding description (9), the invention consists of placing accelerating means between the multiplicity of planes that have arrays of magnetic materials. The re-circulating beam current 1 is accelerated by these accelerating means to the desired energy.

What is claimed is:

1. In an apparatus having:
   a. an axis;
   b. a current that flows along said axis; a current-guiding system comprising:
   c. an array of magnetic materials surrounding said current, said array being symmetrically arranged with respect to said axis and being magnetized by said current, thereby producing magnetic fields to guide said current along said axis.

2. In an apparatus having:
   a. an axis;
   b. a charged particle beam current that flows along said axis; a current-guiding system comprising:
   c. an array of magnetic materials surrounding said current, said array utilizing the magnetomotive force of said current to produce magnetic fields that guide said current along said axis; said array consisting of magnetic units arranged symmetrically with respect to said axis; each of said units consisting of a pair of approximately radial magnetic vanes having an angular separation approximately given by:

$$\text{Vane angle} = 180/n$$

wherein n denotes the number of said magnetic units, each vane pair being connected by a magnetic member encircling said current, said magnetic member having a uniformly-distributed coil having ampere-turns opposing the magnetomotive force of said current approximately in accordance with the relation:

$$\text{Ampere-turns} = -l(n-1)/n$$

wherein l represents said current and n represents the number of said magnetic units.

3. The charged particle beam current guiding system of claim 2 in which a first array of magnetic materials is symmetrically arranged with respect to said axis of claim 2 and located in a first plane intersecting said axis at approximately ninety degrees, and a second array of magnetic materials located in a second plane intersecting said axis at approximately ninety degrees, said second plane being spaced apart from said first plane along said axis, said second array of magnetic materials being symmetrically arranged with respect to said axis and being at a rotation angle with respect to said first array of magnetic materials located in said first plane.

4. The charged particle beam current guiding system of claim 2 in which a multiplicity of planes have spaced-apart relations along said axis; each plane of said multiplicity of planes intersecting said axis at approximately ninety degrees; each plane having on it an array of magnetic materials symmetrically arranged with respect to said axis; said arrays of magnetic materials being positioned at a rotation angle with respect to one another; said arrays having a front end at which said current is introduced along said axis and having an aft end at which said current leaves said axis.

5. The charged particle beam current guiding system of claim 4 in which accelerating means are positioned between said multiplicity of planes, whereby said charged particles have their velocities increased.

6. The charged particle beam current guiding system of claim 4 in which said arrays of magnetic materials are arranged at successively gradually smaller radii, thereby "squeezing" said beam to a successively smaller radius.

7. A current-guiding system comprising:

a. an axis that is curved and re-entrant on itself;

b. a beam current having charged particles flowing along said axis;

c. an array of magnetic materials surrounding said beam current, said array utilizing the magnetomotive force of said beam current to produce magnetic fields that guide said beam current along said axis; said array consisting of magnetic units arranged symmetrically with respect to said axis; each of said units consisting of a pair of approximately radial magnetic vanes having an angular separation approximately given by:

$$\text{Vane angle} = 180/n$$

wherein n denotes the number of said magnetic units, each vane pair being connected by a magnetic member encircling said beam current, said magnetic member having a uniformly-distributed coil having ampere-turns opposing the magnetomotive force of said current approximately in accordance with the relation:

$$\text{Ampere-turns} = -I(n-1)/n$$

wherein I represents said current and n represents the number of said magnetic units.

8. The current-guiding system of claim 7 in which a multiplicity of planes have spaced-apart relations along said axis; each plane of said multiplicity of planes intersecting said axis at approximately ninety degrees; each plane having on it an array of magnetic materials symmetrically arranged with respect to said axis; said arrays of magnetic materials being positioned at a rotation angle with respect to one another.

9. The current-guiding system of claim 8 in which accelerating means are positioned between said multiplicity of planes, whereby said charged particles of said beam have their velocities increased.

* * * * *